US009207025B2

(12) United States Patent
Varanasi et al.

(10) Patent No.: US 9,207,025 B2
(45) Date of Patent: Dec. 8, 2015

(54) METHODS FOR PROMOTING NUCLEATE BOILING

(71) Applicant: Massachusetts Institute of Technology, Cambridge, MA (US)

(72) Inventors: Kripa K. Varanasi, Lexington, MA (US); Christopher Jameson Love, Atlantis, FL (US)

(73) Assignee: Massachusetts Institute of Technology, Cambridge, MA (US)

( * ) Notice: Subject to any disclaimer, the term of this patent is extended or adjusted under 35 U.S.C. 154(b) by 114 days.

(21) Appl. No.: 13/973,959

(22) Filed: Aug. 22, 2013

(65) Prior Publication Data

US 2014/0314947 A1 Oct. 23, 2014

Related U.S. Application Data

(60) Provisional application No. 61/692,067, filed on Aug. 22, 2012.

(51) Int. Cl.

| | |
|---|---|
| ***F28F 13/18*** | (2006.01) |
| ***B24B 1/00*** | (2006.01) |
| ***B24B 1/04*** | (2006.01) |
| ***B05D 7/22*** | (2006.01) |
| ***F22B 37/00*** | (2006.01) |
| ***F22B 37/10*** | (2006.01) |
| ***F28F 19/00*** | (2006.01) |
| ***F22B 37/56*** | (2006.01) |

(52) U.S. Cl.

CPC . *F28F 13/18* (2013.01); *B05D 7/22* (2013.01); *B05D 7/222* (2013.01); *B24B 1/00* (2013.01); *B24B 1/002* (2013.01); *B24B 1/005* (2013.01); *B24B 1/007* (2013.01); *B24B 1/04* (2013.01); *F22B 37/00* (2013.01); *F22B 37/10* (2013.01); *F22B 37/56* (2013.01); *F28F 13/182* (2013.01); *F28F 13/185* (2013.01); *F28F 13/187* (2013.01); *F28F 19/00* (2013.01); *B05D 2254/04* (2013.01); *F28F 2245/00* (2013.01); *F28F 2245/06* (2013.01)

(58) Field of Classification Search

USPC ..... 427/230–239

See application file for complete search history.

(56) References Cited

U.S. PATENT DOCUMENTS 4,663,243 A 5/1987 Czikk et al.
2010/0224638 A1* 9/2010 Rubner et al. ..... 220/660

FOREIGN PATENT DOCUMENTS

JP 57164292 A 10/1982

OTHER PUBLICATIONS

Ahn et al., Pool Boiling CHF Enhancement by Micro/Nanoscale Modification of Zircaloy-4 Surface, Nuclear Engineering and Design, vol. 240, (2010).
Bornhorst et al., Reduction of Scale Formation Under Pool Boiling Conditions by Ion Implantation and Magnetron Sputtering on Heat Transfer Surfaces, Heat Transfer Engineering, vol. 20 No. 2, (1999).
Chen et al., Nanowires for Enhanced Boiling Heat Transfer, Nano Letters, vol. 9 No. 2, (2009).
Cho et al., Theory of Electronic Anti-Fouling Technology to Control Precipitation Fouling in Heat Exchangers, Int. Comm. Heat Mass Transfer, vol. 24, No. 6, pp. 757-770, (1997).
Douglas et al., Acoustically Enhanced Boiling Heat Transfer, Phys. Fluids, vol. 24, (2012).
Elrod et al., Boiling Heat-Transfer Data at Low Heat Flux, Journal of Heat Transfer, (1967).
Esawy et al., Effect of Deposit Formation on the Performance of Annular Finned Tubes During Nucleate Pool Boiling, Proceedings of International Conference on Heat Exchanger Fouling and Cleaning, (2011).
Esawy et al., Mechanism of Crystallization Fouling During Pool Boiling of Finned Tubes, Thirteenth International Water Technology Conference, Hurghada, Egypt, (2009).
International Search Report, PCT Application No. PCT/US2013/056285, dated Feb. 19, 2014, 4 pages.
Jalalirad et al., Cleaning Action of Spherical Projectiles in Tubular Heat Exchangers, International Journal of Heat and Mass Transfer, vol. 57, (2013).
Jamialahmadi et al., A New Model for the Effect of Calcium Sulfate Scale Formation on Pool Boiling Heat Transfer, Journal of Heat Transfer, vol. 126, (2004).
Jamialahmadi et al., Bubble Dynamics and Scale Formation During Boiling of Aqueous Calcium Sulphate Solutions, Chemical Engineering and Processing: Process Intensification, vol. 26, (1989).
Khan et al., Pool Boiling Heat Transfer Enhancement by Surface Modification/Micro-Structures for Electronics Cooling: A Review, EPTC, IEEE, pp. 273-280 (2004).

(Continued)

*Primary Examiner* — William Phillip Fletcher, III
(74) *Attorney, Agent, or Firm* — Choate, Hall & Stewart LLP

(57) ABSTRACT

Method for promoting nucleate boiling on an interior surface of a vessel for boiling fluid in an industrial process, the method comprising the steps of: providing the vessel having the interior surface; controllably depositing a scale layer having a non-zero thickness onto the interior surface; monitoring an average thickness, x, of the deposit of the layer; and maintaining the average thickness, x, of the layer below a predetermined value or within a predetermined range of values during the operational life of the vessel, wherein $x<k/h$, wherein k is the effective thermal conductivity of the interior surface of the vessel and h is the heat transfer coefficient at the interior surface of the vessel in contact with the boiling fluid.

29 Claims, 8 Drawing Sheets

(56) References Cited

OTHER PUBLICATIONS

Kim et al., Effect of Nanoparticles on CHF Enhancement in Pool Boiling of Nano-Fluids, International Journal of Heat and Mass Transfer, vol. 49, (2006).
Kim et al., Effects of Nano-Fluid and Surfaces With Nano Structure on the Increase of CHF, Experimental Thermal and Fluid Science, vol. 34, (2010).
Kwark et al., Effect of Soluble Additives, Boric Acid (H3BO3) and Salt (NACL), in Pool Boiling Heat Transfer, Nuclear Engineering and Technology, vol. 43, No. 3, (2011).
Li et al., Nature-Inspired Boiling Enhancement by Novel Nanostructured Macroporous Surfaces, Adv. Funct. Mater., vol. 18, (2008).
Li et al., Parametric Study of Pool Boiling on Horizontal Highly Conductive Microporous Coated Surfaces, ASME J. of Heat Transfer, v. 129, (2007).
Malayeri et al., Application of Nano-Modified Surfaces for Fouling Mitigation, Int. J. Energy Res., 33:1101-1113, (2009).
Malayeri et al., Fouling of Tube Bundles Under Pool Boiling Conditions, Chemical Engineering Science, vol. 60, (2005).
Sarathi et al., Practical Aspects of Steam Injection Processes a Handbook for Independent Operators, IIT Research Institute, (1992).
Solano et al., Performance Evaluation of a Zero-Fouling Reciprocating Scraped Surface Heat Exchanger, Proceedings of International Conference on Heat Exchanger Fouling and Cleaning VIII, (2009).
Tijing et al., Effect of High-Frequency Electric Fields on Calcium Carbonate Scaling, Desalination, vol. 279 (2011).
Tijing et al., Physical Water Treatment Using RF Electric Fields for the Mitigation of CaCO3 Fouling in Cooling Water, International Journal of Heat and Mass Transfer, vol. 53, (2010).
Wang et al., Antifouling and Enhancing Pool Boiling by TiO2 Coating Surface in Nanometer Scale Thickness, AIChE Journal, vol. 53, No. 12, (2007).
Written Opinion, PCT Application No. PCT/US2013/056285, dated Feb. 19, 2014, 6 pages.

* cited by examiner

METHODS FOR PROMOTING NUCLEATE BOILING

CROSS-REFERENCE TO RELATED APPLICATIONS

This application claims priority to and the benefit of, U.S. Provisional Patent Application No. 61/692,067, filed Aug. 22, 2012, the contents of which are incorporated herein by reference in their entirety.

GOVERNMENT SUPPORT

This invention was made with government support under Grant No. N66001-10-1-4047 awarded by the Space and Naval Warfare Systems Center. The government has certain rights in this invention.

TECHNICAL FIELD

This invention relates generally to articles, devices, and methods for enhancing boiling heat transfer. More particularly, in certain embodiments, the invention relates to articles, devices, and methods for enhancing boiling heat transfer by using a controlled deposit of scale.

BACKGROUND

Scale formation is viewed as a persistent problem encountered in various industrial processes; it results in a significant reduction of the efficiency of these processes and the useful lifetime of the associated equipment. The challenges posed by scale formation have a significant impact on capital costs and operating costs.

Mineral scale deposits such as calcium sulfate are encountered in many industrial processes. These scales have low solubility limits, particularly at elevated temperatures (e.g., at or above 100° C.). Thus, processes involving boiling fluids may be even more affected by scale deposits, since scale forms more readily on surfaces, becomes thick, and adversely affects heat transfer and operability of the equipment.

Various surfaces have been developed for heat exchanger equipment to promote heat transfer; however, these surfaces are usually tested under ideal conditions: with deionized water with no scale deposition. In boilers and steam generation components, surface scale formation and fouling occurs such that over time a thick scale deposit will cover an initially scale-free surface. Scale is generally considered undesirable due to its low thermal conductivity. Thus, there is a need for improved surfaces and vessels to promote efficient heat transfer.

Certain conventional methods focus entirely on keeping as much scale as possible off of the surface by surface modification techniques for fouling mitigation or by using electric fields to inhibit scale formation. Yet, certain other conventional methods focus on mechanical removal of the entire scale deposition—for example, by injecting particles or using a mechanical part installed inside of a tube to scrape and clean away any scale buildup. These methods fail to appreciate the possibility of using the scale deposition to increase boiling heat transfer.

Certain conventional methods have tested data on surface scale formation and changes in heat transfer coefficient over time. However, these conventional methods fail to appreciate or contemplate controlling scale formation to enhance boiling heat transfer.

Other conventional methods relate to the effects of nanofluids on boiling heat transfer. These methods study the correlation between the deposition of nanoparticles from solution onto the surface and the rate of boiling heat transfer. These conventional methods fail to appreciate or contemplate using solution deposition as a method of enhancing heat transfer. Certain other conventional methods relate to the effects of depositing materials (e.g., nanoparticles) on the surface before boiling. Thus, conventional methods focus on direct texturing and treatment of surfaces before boiling to achieve heat transfer improvements.

SUMMARY OF THE INVENTION

Historically, scale has been viewed negatively, and methods for the removal or prevention of scale formation on the surface of equipment have been developed, as discussed above. However, it is presently found that, surprisingly, creating and/or maintaining a scale deposit at a controlled thickness (e.g., below a maximum thickness or within a range of desired thicknesses) actually enhances a type of boiling called nucleate boiling, which improves heat transfer. Nucleate boiling may provide a heat transfer coefficient up to an order of magnitude greater than filmwise boiling; thus, promotion of nucleate boiling is beneficial to heat transfer.

The present disclosure provides, among other things, scale-coated surfaces, vessels with controlled deposits of scale, and associated methods for enhanced boiling heat transfer. The articles and methods presented herein are useful to a wide variety of industries, including utilities, oil and gas industries, desalination facilities, food processing plants, manufacturing facilities, and the like. The articles and methods presented herein are useful in a wide variety of industrial processes that involve heat transfer.

In the oil and gas industry, a type of enhanced oil recovery uses steam that is injected into the reservoir. The steam is produced by burning natural gas or crude oil. In typical existing steam generators, scale forms uncontrollably over time with multiple cost-increasing effects: more fuel is needed to maintain the same steam output, the area of heat exchange is overdesigned, and maintenance time for equipment cleaning is increased (thereby decreasing product output and increasing overall upkeep costs).

In terms of fuel-loss alone, the economic benefit of controlling scale formation to enhance heat transfer is considered for an industrial-size fire-tube boiler. An estimate from the U.S. Department of Energy is that scale deposited to a thickness of 1/16 inch would result in an overall fuel loss of about 3.9%. At an output of 450,000 million Btu per year and an energy price of $15.00 per million Btu for crude oil, the annual operating cost increase would be $263,250. Therefore, the enhanced heat transfer from controlling scale formation results in annual savings of at least $263,000.

In thermal desalination, water is boiled and recondensed to leave behind impurities; therefore, the main component of thermal desalination is a steam generator/boiler system. These impurities include salts that deposit over time as thick scales in the steam generators. In anticipation of this thick scale formation, the steam generators are typically overdesigned to account for the lower heat transfer over time. The enhanced heat transfer by the concepts discussed in the present application lowers fuel and capital costs of the steam generation and provides a significant annual financial benefit on the order of hundreds of thousands of dollars. Moreover, it results in conservation of natural sources. The lower costs may also make thermal desalination a competitive option for providing clean drinking water, especially for coastal projects that desalinate seawater.

One aspect of the present invention relates to a method for enhancing boiling heat transfer of an interior surface of a vessel for use in an industrial process. The method includes the steps of providing the vessel (e.g., a reaction vessel or a pipe) having an interior surface. The method also includes controllably depositing a scale layer having a predetermined thickness, x, onto the interior surface for enhanced boiling heat transfer when in contact with a boiling fluid. The method includes monitoring an average thickness, x, of the scale layer; and maintaining an average thickness, x, of the scale layer below a predetermined value or within a predetermined range of values for a substantial period of time during an operational life of the vessel.

Another aspect of the present invention relates to a method for enhancing boiling heat transfer of an interior surface of a vessel for use in an industrial process. The method further includes providing the vessel having an interior surface including a photoactive coating and allowing for accumulation of a deposit of scale on the interior surface of the vessel up to a maximum average thickness, x, by contact of the interior surface with boiling fluid during normal operation of the vessel in the industrial process. The method also includes maintaining the average thickness, x, of the deposit of scale below a predetermined value or within a predetermined range of values for a substantial period of time during an operational life of the vessel by intermittent or continuous exposure to a light source to break up scale deposits.

According to some embodiments of the invention, the operational life of the vessel varies depending on the type of vessel and/or the application. The operational life of the vessel may, for example, exceed two months.

According to some embodiments, the invention relates to reducing the amount of scale (e.g., reducing the thickness of the deposited scale layer) if the thickness x of the scale layer is above the predetermined value or the predetermined range of values; and measuring the average thickness x of the scale layer to determine whether the average thickness x of the scale layer is below the predetermined value or within the predetermined range of values.

Another embodiment of the present invention relates to monitoring and/or continuously measuring the average thickness of the scale layer to determine if any amount of the scale layer needs to be removed (e.g., if the thickness x of the scale layer needs to be reduced). The thickness x of the scale layer may be monitored and or measured at predetermined intervals, the intervals being determined depending on the application. Suitable intervals include, e.g., every few seconds (e.g., every 5-10 seconds), every few minutes (e.g., every 1-10 minutes), every few hours (e.g., every 1-5 hours), or every few days (e.g., every 1-3 days). Any other suitable time intervals may be used for measuring and monitoring the thickness x of the scale layer.

Another aspect of the present invention relates to a method for enhancing boiling heat transfer of an interior surface of a vessel for use in an industrial process. The method includes providing the vessel having an interior surface; and controllably depositing scale onto the interior surface according to a predetermined pattern for enhanced boiling heat transfer when in contact with a boiling fluid.

A further aspect of the present invention relates to a vessel for use in an industrial process. The vessel has an interior surface suitable for contact with a boiling fluid. The interior surface includes a controlled deposit of scale that provides enhanced boiling heat transfer when in contact with the boiling fluid.

BRIEF DESCRIPTION OF THE DRAWINGS

The objects and features of the invention can be better understood with reference to the drawings described below, and the claims.

DETAILED DESCRIPTION

Figure 1:
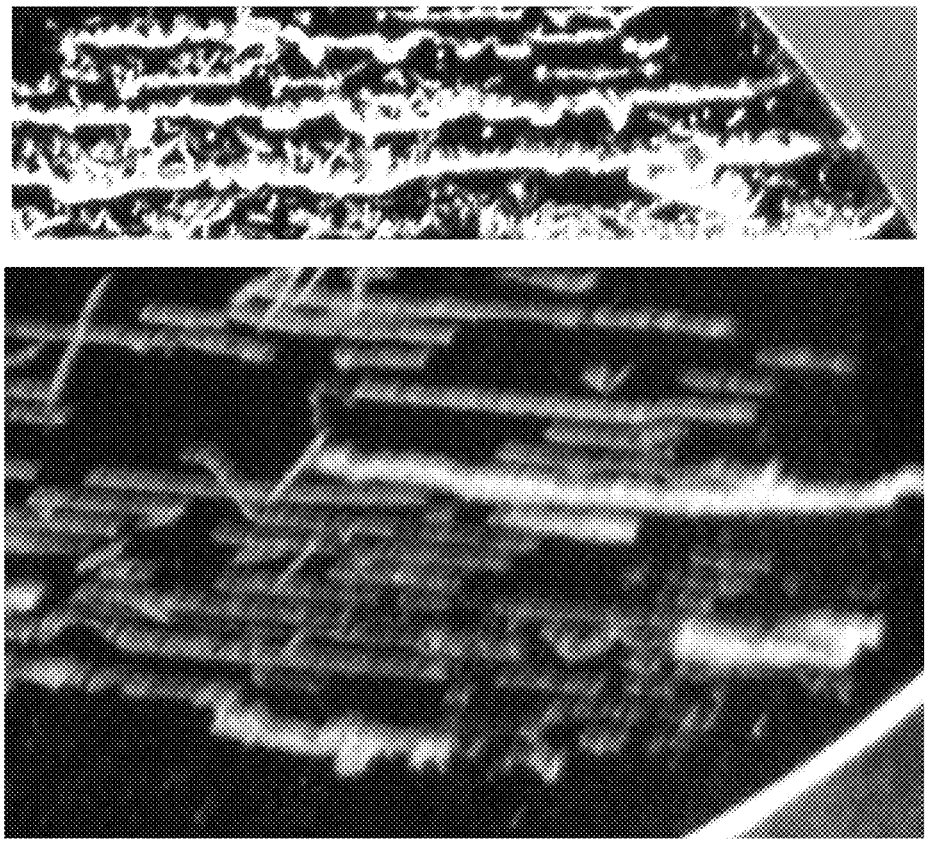
FIG. 1 are two photos of the surface of an exemplary scale coating deposited on a silicon substrate, according to an illustrative embodiment of the invention.

It is contemplated that compositions, systems, devices, methods, and processes of the claimed invention encompass variations and adaptations developed using information from the embodiments described herein. Adaptation and/or modification of the compositions, systems, devices, methods, and processes described herein may be performed by those of ordinary skill in the relevant art.

Throughout the description, where articles, devices, and systems are described as having, including, or comprising specific components, or where processes and methods are described as having, including, or comprising specific steps, it is contemplated that, additionally, there are articles, devices, and systems of the present invention that consist essentially of, or consist of, the recited components, and that there are processes and methods according to the present invention that consist essentially of, or consist of, the recited processing steps.

Similarly, where articles, devices, and compositions are described as having, including, or comprising specific compounds and/or materials, it is contemplated that, additionally, there are articles, devices, mixtures, and compositions of the present invention that consist essentially of, or consist of, the recited compounds and/or materials.

It should be understood that the order of steps or order for performing certain action is immaterial so long as the invention remains operable. Moreover, two or more steps or actions may be conducted simultaneously.

The mention herein of any publication, for example, in the Background section, is not an admission that the publication serves as prior art with respect to any of the claims presented herein. The Background section is presented for purposes of clarity and is not meant as a description of prior art with respect to any claim.

It is contemplated in this present disclosure that controlled scale coatings can be used in boiler and steam generation components in power plants, desalination systems, food processing facilities, oil and gas fields, etc., to enhance heat transfer. Vessels for which this is useful include containers, enclosures, tanks, pipes, pumps, reactors, columns, and other equipment that contains or comes into contact with a fluid, for example, a boiling liquid. Such vessels and surfaces may be made of, for example, metal, such as copper, brass, steel, stainless steel, aluminum, aluminum bronze, nickel, iron, and/or nickel iron aluminum bronze. Such vessels and surfaces may be made of polymer, glass, rubber, silicon, polycarbonate, PVC, and/or other materials. Such vessels and surfaces may have coatings in addition to the scale coating, for example, a polymer or fluoropolymer.

Scale Depositions

In general, any of a variety of scale materials can be used to coat a surface in accordance with the present disclosure, as long as the coating is operative to enhance heat transfer. Controlled scale deposition in accordance with certain embodiments of the present invention results in 100% improvement in heat transfer coefficient and a 2× improvement in critical heat flux (CHF) over conventional uncontrolled surfaces. Exemplary scale materials include, but are not limited to, calcium sulfate, calcium carbonate, magnesium phosphate, calcium phosphate, silica, $CaSiO_3$, and $MgSiO_3$, and any combination thereof. Additionally or alternatively, typical minerals (which are naturally occurring inorganic compounds) can be used to coat heat exchanger surfaces including, for example, hematite, serpentine, gypsum, magnetite or any combination thereof.

According to certain embodiments of the present invention, a layer of scale is deposited on an interior surface of a vessel (e.g., any surface on the inside of the vessel) or on another surface where nucleate boiling is to take place.

Without being bound to any particular theory, a thickness of a scale deposition used in accordance with the present disclosure x can be less than k/h to keep convection at the solid-liquid interface as the dominant resistance to heat transfer and not conduction through the additional scale layer (of low thermal conductivity). A person of ordinary skill in the art would appreciate that k represents thermal conductivity and h represent heat transfer coefficient. Typically, the thermal conductivity of scale is on the order of 1 W/mK and the heat transfer coefficient of water boiling is on the order of 10,000 $W/m^2K$. Without being bound to any particular theory, high heat transfer coefficients in nucleate boiling result from fluid mixing and motion near the heated surface. Conditions affecting the heat transfer coefficient include nucleation site density, bubble diameter, and bubble departure frequency; scale can influence the heat transfer coefficient by manipulating these factor(s). The material composition of the surface on which the scale is deposited may also influence the heat transfer coefficient. For example, the presence of scale may increase nucleation site density and therefore increase the heat transfer coefficient. Generally, the critical heat flux (CHF) involves a balance between liquid wettability and vapor permeability. When vapor is trapped in a given area of the surface and the liquid no longer wets that area, a hot spot occurs due to the low thermal conductivity of the entrained vapor layer. To enhance CHF, the transition to forming a stable vapor blanket near the surface is delayed by minimizing large bubble coalescence at the surface and maintaining fluid mixing and liquid contact with the surface. The surface structures created by a scale deposit may result in higher surface wettability of the liquid phase and good vapor permeability such that CHF is increased over the plain surface.

In some embodiments, when a scale deposition that completely covers a metal surface (e.g., copper or other suitable reaction surface), its thickness, x, is less than 100 micrometers to achieve the highest level of heat-transfer enhancement compared to the baseline fully fouled surface. In other embodiments, if the scale deposition is porous and/or does not completely cover the underlying heat exchanger surface, then an effective thermal conductivity, $k_{eff}$, is used where $k_{eff}=k_{scale}$*(scale area fraction exposed to liquid)+$k_{metal}$* (metal area fraction exposed to liquid), where $k_{scale}$ is the thermal conductivity of the scale and $k_{metal}$ is the thermal conductivity of the metal (or other substrate). For example, a copper surface with 75% of its area covered by a scale deposition, the thickness of the scale deposition, x, can be less than 0.03 mm to achieve the highest level of heat-transfer enhancement.

According to certain embodiments, an entire surface area may be covered by scale deposition, or, alternatively, only portions of the surface area may be covered by scale deposition (e.g., portions that are likely to come into contact with liquids). In other embodiments, the scale deposition may be applied according to a predetermined pattern (e.g., certain portions of the heat exchanger surface are covered by a scale deposition and certain portions are not covered by scale deposition). The scale deposition may include one more materials depending on the desired effect and/or the application. In certain embodiments, certain portions of the surface area may be covered by a scale deposition including a first material, while other portions of the surface area may be covered by a scale deposition including a second material.

According to different materials and applications, it would be appreciated that thickness of a controlled scale deposit (i.e., x) may vary depending on a variety of factors, including the particular application. A thickness can be an average thickness (e.g., a thickness measured at a representative location within the scale deposit and/or the average of thicknesses measured at one or more representative locations). The thickness of the scale deposit may be uniform throughout the surface area. Alternatively, the thickness of the scale deposit may vary throughout the surface area.

In some embodiments, a thickness is less than about 1000 microns, less than about 500 microns, less than about 100 microns, less than about 90 microns, less than about 80 microns, less than about 70 microns, less than about 60 microns, less than about 50 microns, less than about 40 microns, less than about 30 microns, less than about 20 microns, less than about 10 microns, less than about 5 microns, or even less than about 1 micron. In some embodiments, the thickness is within a range from about 1 micron to about 1000 microns. In some embodiments, the thickness is within a range from about 10 microns to about 100 microns. In some embodiments, the thickness is within a range from about 500 microns to about 1000 microns, from about 100 microns to about 500 microns, from about 50 microns to about 100 microns, from about 10 microns to about 50 microns, or from about 5 microns to about 10 microns.

One example of a scale deposition in accordance with one embodiment of the present invention is a steel surface with a calcium carbonate or calcium sulfate scale surface deposited in a periodic pattern such that the scale has an average thickness of 50 microns in one application and 100 microns in the other.

In accordance with the present disclosure, exemplary patterns of scale deposition that can be used include, but are not limited to, hills, posts, pores, cavities, and features having multiple length-scales, and any combination thereof.

A variety of geometries/patterns have been demonstrated in the literature to improve boiling heat transfer with deionized water. It is recognized in the present disclosure that one or more of those geometries/patterns can be formed with a scale deposition itself and may serve to further enhance heat transfer. These geometries may improve boiling heat transfer by increasing water wettability through surface roughness and capillary forces and providing passages for vapor escape so as to delay the formation of a vapor blanket layer at the surface and transition to the unfavorable filmwise boiling regime. Exemplary patterns illustrated in Kim et al., "Effects of nano-fluid and surfaces with nano structure on the increase of CHF," Experimental Thermal and Fluid Science, v. 34, 2010; Chen et al., "Nanowires for Enhanced Boiling Heat Transfer," Nano Letters, v. 9, 2009; Li et al., "Parametric Study of Pool Boiling on Horizontal Highly Conductive Microporous Coated Surfaces," ASME J. of Heat Transfer, v. 129, 2007; Ahn et al., "Pool boiling CHF enhancement by micro/nanoscale modification of zircaloy-4 surface," Nuclear Engineering and Design, v. 240, 2010; and Li et al., "Nature-Inspired Boiling Enhancement by Novel Nanostructured Macroporous Surfaces," Adv. Funct. Mater., v. 18, 2008 may be used with a scale deposition in accordance with the present disclosure.

Methods

Many known coating techniques including lithography, sputter deposition, laser etching, layer-by-layer deposition, anodization, and application of an electric field can be used to create a scale deposition in accordance with the present disclosure. These coating techniques are used to alter the surface chemistry or geometry so that deposition of a scale deposition occurs controllably on the surface. Regions of mixed composition of surface chemistry or geometry control the surface's interaction with scale deposition and allow for a patterned surface-scale deposition.

Figure 8:
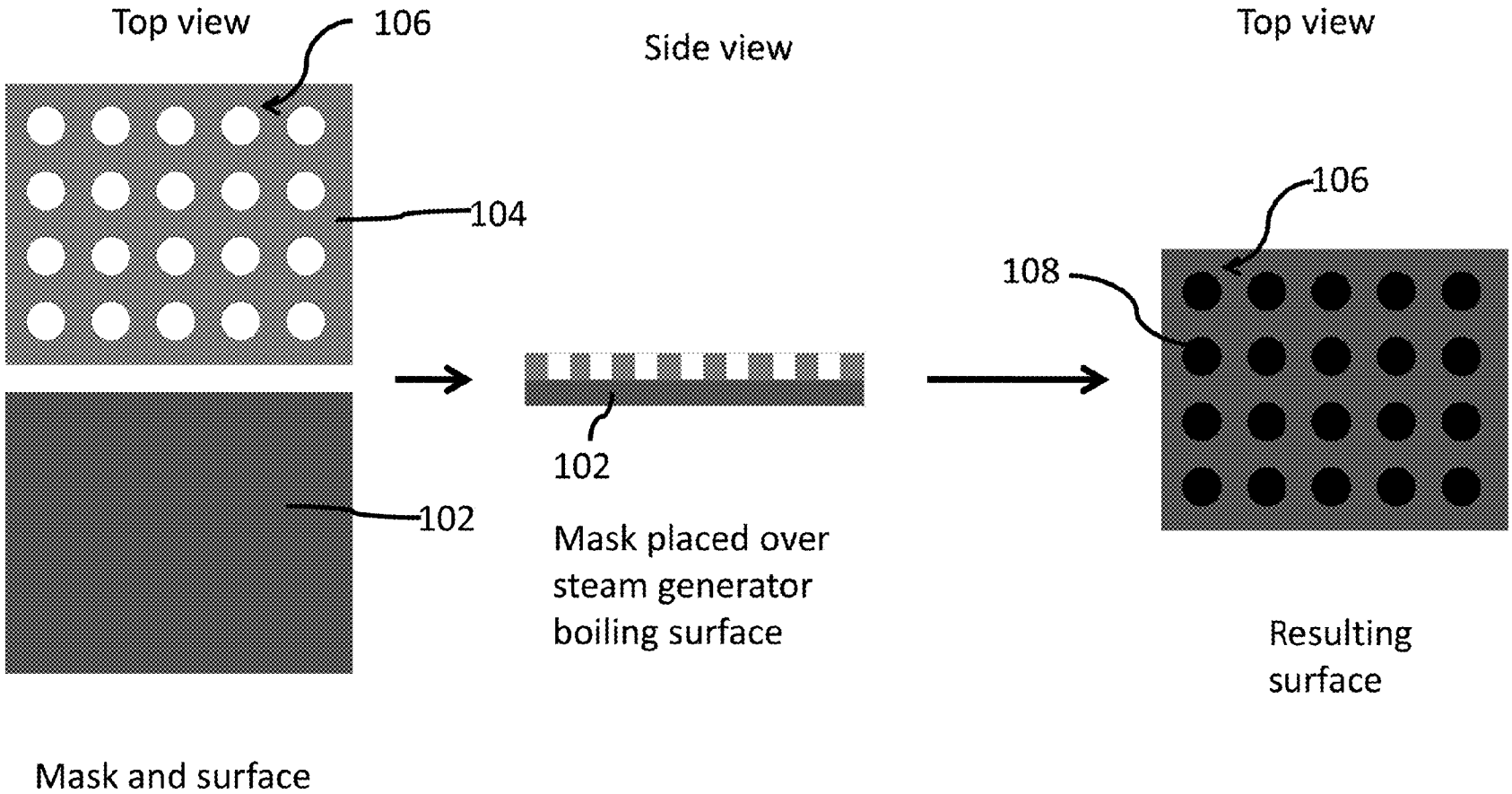
FIG. 8 is a schematic diagram showing an exemplary scale deposition method using a mask.

Referring now to FIG. 8, a surface 102 and a mask 104 are provided. The mask 104 has a predetermined pattern 106. The mask 104 is placed over and in contact with the surface 102. Scale material is then deposited over the mask 104 by physical vapor deposition (e.g., by sputtering, electron beam, etc. deposition of a desired scale material). The mask 104 is then removed from the surface 102. The surface 102 is then coated with the scale according to the predetermined pattern 106. For example, as shown in FIG. 8, the predetermined pattern 106 may include a matrix of posts 108 spaced on the surface 102. The posts 108 may be evenly spaced as shown in FIG. 8 or the posts 108 may be spaced according to any desired pattern.

In some embodiments, scale preferentially nucleates on certain parts of a surface thereby forming a pattern on the surface. For example, the deposited material may have a much lower or higher surface energy compared to the starting boiling surface and therefore scale would deposit in a pattern based on preferential nucleation on regions of high surface energy. For example, in some embodiments, a material is deposited in a pattern such that scale preferentially nucleates (or does not nucleate) on the deposited material, thereby forming a pattern of scale on the surface.

According to certain embodiments of the present invention, the scale covers between about 5 and about 98% of the surface area of the interior surface. In certain embodiments, the scale covers more than 1%, more than 5%, more than 10%, more than 20%, more than 30%, more than 40%, more than 50%, more than 60%, more than 70%, more than 80%, more than 90%, or more than 95% of the interior surface. The pattern deposited on the interior surface may include voids or spaces where no scale was deposited; the surface area that is not covered by any scale deposit may amount to between about less than 1% to more than about 90% of the total surface area of the interior surface. In certain embodiments, the non-scale portion of the surface is more than 1%, more than 5%, more than 10%, more than 20%, more than 30%, more than 40%, more than 50%, more than 60%, more than 70%, more than 80%, more than 90%, or more than 95% of the interior surface. In some embodiments, the pattern deposited on the surface may be a random arrangement of scale-covered and non-scale covered portions of the surface. In some embodiments, the pattern deposited on the surface may be an ordered, non-random arrangement of scale-covered and non-scale covered portions of the surface.

Figure 9:
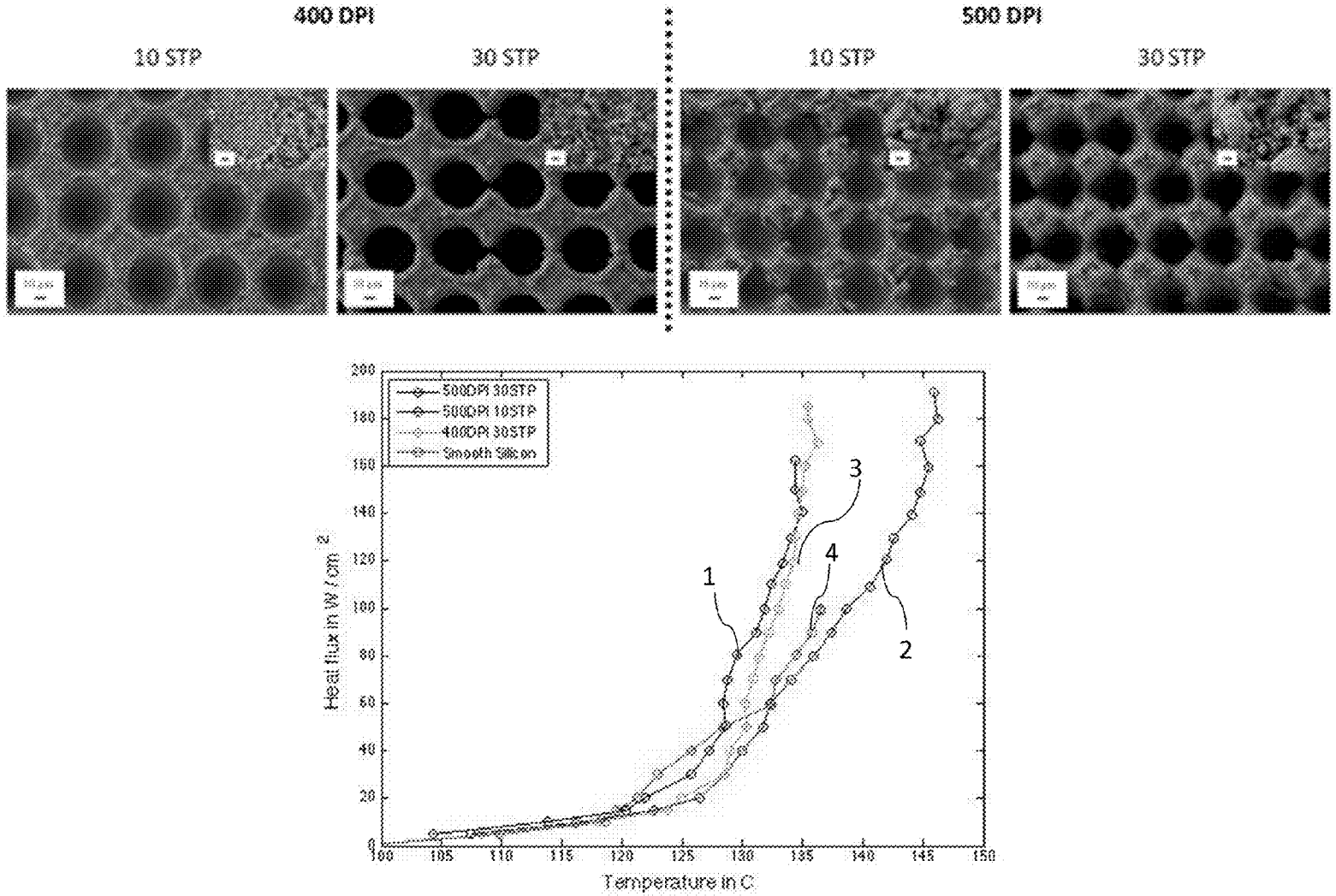
FIG. 9 shows a series of images of textured patterns in silicon and a chart from associated heat transfer experiments.

FIG. 9 shows a series of images of textured patterns in silicon and associated experimental heat transfer results. The two images on the left show images of hole (400 dots per inch (DPI)) patterns and the two images on the right are images of hill (500 DPI) patterns made by controlling scale deposition. DPI is a parameter controlling the density of laser pulses over a given area. A higher DPI indicates a higher density of laser pulses per unit area. STP refers to the number of steps or repetitions of the laser scan over the same area. The insert in the top-right corner of every image shows nanoscale roughness (1 micron) on the microscale patterns. Smooth silicon was textured by a laser. On the opposite side of these laser-textured silicon surfaces, a thin metal heater was patterned out of titanium (for Joule heating) and silver (for electrical connection to power supply). The samples were placed in a chamber such that deionized water was in contact with the laser-textured side and the backside heater was open to air. The experiments were conducted under atmospheric conditions with the deionized water maintained at a temperature of 100° C. by an isothermal bath. Surface temperature was determined by averaging calibrated infrared video data over the area of the exposed titanium heater. The heat flux was determined by the amount of current and voltage applied to the titanium thin film and its area. The final point on each curve corresponds to critical heat flux. The graph on the bottom of FIG. 9 shows the correlation between the temperature and the heat flux of (1) 500 DPI, 30 STP hill patterned sample; (2) 500 DPI, 10STP hill patterned sample; (3) 400 DPI, 30STP hole patterned sample, and (4) smooth silicon. Smooth silicon refers to the atomically smooth, untextured silicon starting material.

There are a number of papers that discuss studies on scale formation in boiling—e.g., M. Jamialahmadi et al., "Bubble Dynamics and Scale Formation during Boiling of Aqueous Calcium Sulphate Solutions," Chemical Engineering and Processing: Process Intensification, 1989; M. Jamialahmadi and H. Müller-Steinhagen, "A New Model for the Effect of Calcium Sulfate Scale Formation on Pool Boiling Heat Transfer," Journal of Heat Transfer, 2004; M. R. Malayeri et al., "Fouling of tube bundles under pool boiling conditions," Chemical Engineering Science, 2005, pp. 1503-1513; Esawy et al., "Mechanism of Crystallization Fouling during Pool Boiling of Finned Tubes," Thirteenth International Water Technology Conference, 2009, Hurghada, Egypt; and M. R. Malayeri et al., "Effect of Deposit Formation on the Performance of Annular Finned Tubes during Nucleate Pool Boiling," Proceedings of International Conference on Heat Exchanger Fouling and Cleaning, 2011. There are also a number of papers that discuss surface deposition of materials from the liquid phase leading to certain boiling enhancements—e.g., Kim et al., "Effect of nanoparticles on CHF enhancement in pool boiling of nano-fluids," International Journal of Heat and Mass Transfer, 2006; Kim et al., "Effects of nano-fluid and surfaces with nano structure on the increase of CHF," Experimental Thermal and Fluid Science, 2010, pp. 487-495; Kwark et al., "Effect of Soluble Additives. Boric Acid (H3BO3) and Salt (NaCl), in Pool Boiling Heat Transfer," Nuclear Engineering and Technology, Vol. 43 No. 3 Jun.

2011; and Elrod et al., "Boiling Heat-Transfer Data at Low Heat Flux," Journal of Heat Transfer, 1967. There are a number of studies that discuss the use of surface modification techniques for fouling mitigation—e.g., Bornhorst et al., "Reduction of Scale Formation Under Pool Boiling Conditions by Ion Implantation and Magnetron Sputtering on Heat Transfer Surfaces", Heat Transfer Engineering, 1999 and Malayeri et al., "Application of nano-modified surfaces for fouling mitigation," Int. J. Energy Res., 2009, pp. 1101-1113. Certain other studies focus specifically on removing as much scale as possible—e.g., Cho, et al., "Theory of Electronic Anti-Fouling Technology to Control Precipitation Fouling in Heat Exchangers," Int. Comm. Heat Mass Transfer, Vol. 24, No. 6, pp. 757-770, 1997; Tijing et al., "Physical water treatment using RF electric fields for the mitigation of CaCO3 fouling in cooling water", International Journal of Heat and Mass Transfer, 2010, pp. 1426-1437; and Tijing et al., "Effect of high-frequency electric fields on calcium carbonate scaling," Desalination, 2011, pp. 47-53. Certain other studies focus on injecting particles or using a mechanical part inside of a tube to scrape and clean away any scale buildup in the tube—e.g., Solano et al., "Performance Evaluation of a Zero-Fouling Reciprocating Scraped Surface Heat Exchanger," Proceedings of International Conference on Heat Exchanger Fouling and Cleaning VIII, 2009 and Jalalirad et al., "Cleaning action of spherical projectiles in tubular heat exchangers", International Journal of Heat and Mass Transfer, 2013, pp. 491-499. Yet, there are other studies that focus only on boiling experiments conducted in deionized water and do not relate to the effect of the acoustic field on scale—e.g., Douglas et al., "Acoustically enhanced boiling heat transfer," Phys. Fluids, 2012. Other studies focus on the use of $TiO_2$ coating for the purpose of antifouling—e.g., Wang Yan et al., "Antifouling and Enhancing Pool Boiling by $TiO_2$ Coating Surface in Nanometer Scale Thickness," AIChE Journal, 2007. As discussed above, these papers and the methods discussed within them fail to appreciate or contemplate controlling scale formation to enhance boiling heat transfer.

Certain conventional methods focus entirely on keeping as much scale as possible off of the surface by surface modification techniques for fouling mitigation or by using electric fields to inhibit scale formation. Yet, certain other conventional methods focus on mechanical removal of the entire scale deposition—for example, by injecting particles or using a mechanical part installed inside of a tube to scrape and clean away any scale buildup. These methods fail to appreciate the possibility of using the scale deposition to increase boiling heat transfer.

Certain conventional methods have tested data on surface scale formation and changes in heat transfer coefficient over time. However, these conventional methods fail to appreciate or contemplate controlling scale formation to enhance boiling heat transfer.

Other conventional methods relate to the effects of nanofluids on boiling heat transfer. These methods study the correlation between the deposition of nanoparticles from solution onto the surface and the rate of boiling heat transfer. These conventional methods fail to appreciate or contemplate using solution deposition as a method of enhancing heat transfer. Certain other conventional methods relate to the effects of depositing materials (e.g., nanoparticles) on the surface before boiling. Thus, conventional methods focus on direct texturing and treatment of surfaces before boiling to achieve heat transfer improvements.

For example, sputter deposition is a technique that applies a thin (of nanometer to micrometer thickness) metal or ceramic film to a surface. The applied film may have a favorable or unfavorable attraction to scale and/or salt ions based on its chemistry. The sputter deposition process could include the use of a mask that allows for a patterned surface deposition of regions with mixed material compositions.

Anodization can be used to create pores in, e.g., aluminum or steel surfaces. With titanium, pores or nanotubes of titania ($TiO_2$) can be fabricated on the surface. These nanostructured titania surfaces are also photoactive (see below for additional ideas involving the use of a photoactive surface).

An electric field can be used to promote or inhibit the formation of scale in certain regions on the surface. This technique is different from the others in that it is an active, potentially real-time way of controlling surface-scale deposition as opposed to a passive technique that is based on the intrinsic surface chemistry and/or geometry of the underlying heat-exchanger material. An electric field may also be used to control the thickness of the scale deposition on the surface.

Additionally or alternatively, a laser can be used to texture the surface either before boiler installation or afterward. The laser can etch grooves of specified dimensions in the surface or lightly raster the surface to roughen it. The turbulence from the wicking of fluid in these surface textures can be used to control the amount of scale deposited on the surface.

As discussed above, the thickness of a scale deposition can be well controlled. In various embodiments, growth of a scale deposition is limited or controlled so that the thickness is maintained within a desired range. According to certain embodiments of the present invention, the thickness is maintained within about 5% of the desired thickness value or range of values. Alternatively, the thickness is maintained within between about 5-30% of the desired scale layer thickness value or range of values.

In some embodiments, growth may be limited by the injection of a substance into the boiling fluid (e.g., gold nanoparticles or silica particles). The injected particles bind to and cover the surface-deposited scale to inhibit further scale growth in that area. The injected particles could also be designed to lower ion concentration in the bulk liquid by binding and removing positive or negatively charged ions.

In some embodiments, growth may be limited by mechanical removal (e.g., by injecting abrasive particles that fracture long, thin scale depositions, or any other suitable means for mechanical removal of scale). The technique of injecting abrasive particles to fracture the scale deposits could be used as part of routine maintenance of the boiler. Thin, needle-like deposits would be grown that are mechanically weak and fracture upon mechanical contact with abrasive particles flowing in the bulk liquid over the surface. This technique limits the thickness of scale growth on the surface.

In some embodiments, growth may be limited or controlled by applying a photoactive coating (such as titanium dioxide) and an external light source (in the case of titanium dioxide, the source would emit in the ultraviolet range). Scale deposition is controlled by the dramatic change in surface wettability caused by the photoactive surface's interaction with light. In the case of titanium dioxide, the surface becomes superhydrophilic after exposure to UV light and the increased surface attraction of water can cause the displacement of small salt crystals from the surface. A frequency that water does not absorb well can be used; other suitable frequencies may be applied as well. In certain embodiments, one could anodize titanium tubes or titanium-coated copper or steel tubes to form titania nanotubes and pores that are photoactive under UV light as described herein.

Generally, patterns of scale depositions can be created by use of various methods. In some embodiments, patterns of scale depositions are created by using bubble nucleation to control and/or break up scale depositions. Boiling is a process that involves the nucleation, growth, and departure of vapor bubbles on the heated surface. Thus, it is contemplated that scale depositions can be formed structurally weak (e.g., thin, porous) and be further broken up and removed by the rapid bubble growth and departure from the surface. For example, acoustic fields can be used to break up a scale deposition that has already formed in certain regions. The resonant frequency of the scale deposition can be matched by an applied acoustic field that causes the removal of scale from the surface.

Additionally or alternatively, control of water chemistry and use of magnetic particles with applied magnetic fields can be used to induce salt nucleation. In some embodiments, a combination of electric and magnetic fields are used to bind and remove ions in the bulk liquid. The injected particles are magnetic with chemical modifiers that respond to an electric field. One example is iron or iron oxide particles with surface modifications. The externally applied electric field causes ions to bind to the injected particles (scale deposition on the particles) and those particles are navigated and selectively removed by an externally applied magnetic field.

In some embodiments, a scale or salt trap is used, which is a region specifically designed for scale deposition to occur such that the amount of scale formed in other equipment sections is controlled. In this region, salt preferably nucleates out of solution for easy removal from solution. In certain embodiments, carbon dioxide is bubbled into this region such that the formation of carbonate salts is promoted.

According to another embodiment, a device that monitors the thickness of the scale deposition is provided. The device measures the average thickness of the scale deposition (e.g., at one or more representative locations) of the scale-covered area of the vessel. The device provides an indication if the measured thickness of the scale is above a predetermined threshold value or range of predetermined threshold values, indicating that some scale needs to be removed. A desired amount of scale may be removed by any known methods (e.g., mechanical removal methods and other removal methods discussed above).

EXPERIMENTAL EXAMPLES

Coating Silicon with Calcium Sulfate

In these experiments, the scale-coated sample was made by vertically immersing a silicon substrate in a saturated (2 g/L) solution of calcium sulfate in water. An oven was used to maintain a temperature of 45° C. The experiment was run until the solution level was below the level of the substrate (about 24 to 48 hours).

Figure 2:
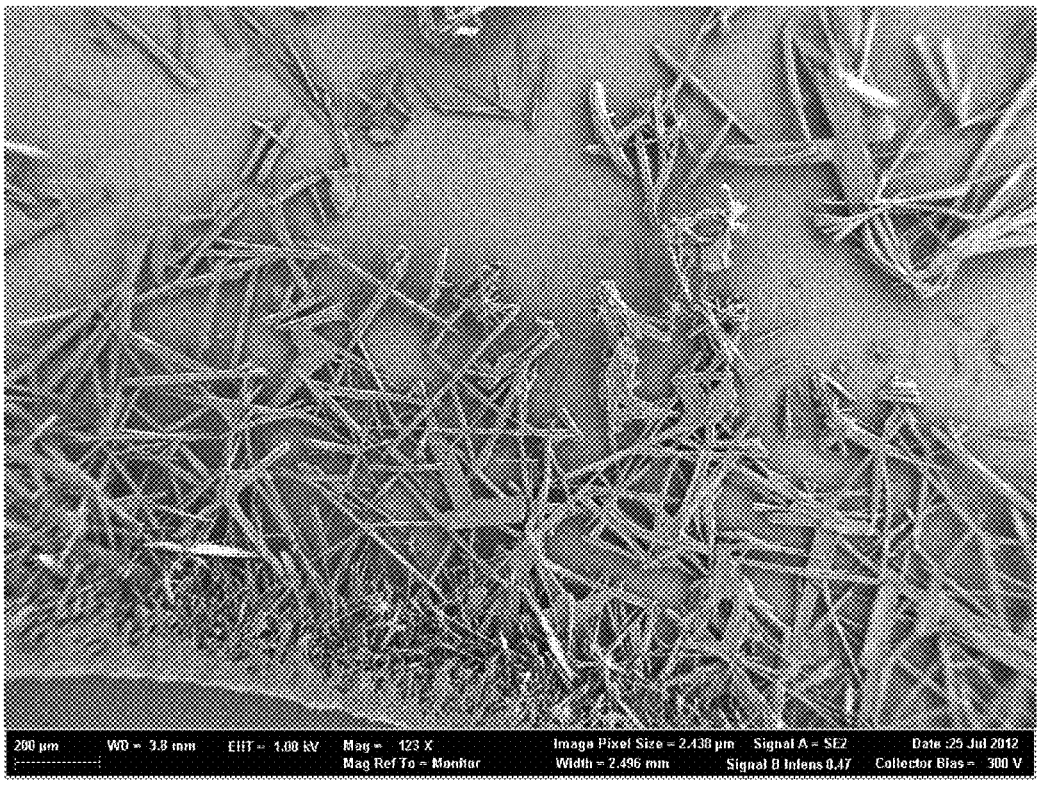
FIGS. 2-4 show SEM images of an exemplary scale deposition, according to an illustrative embodiment of the invention.
Figure 3:
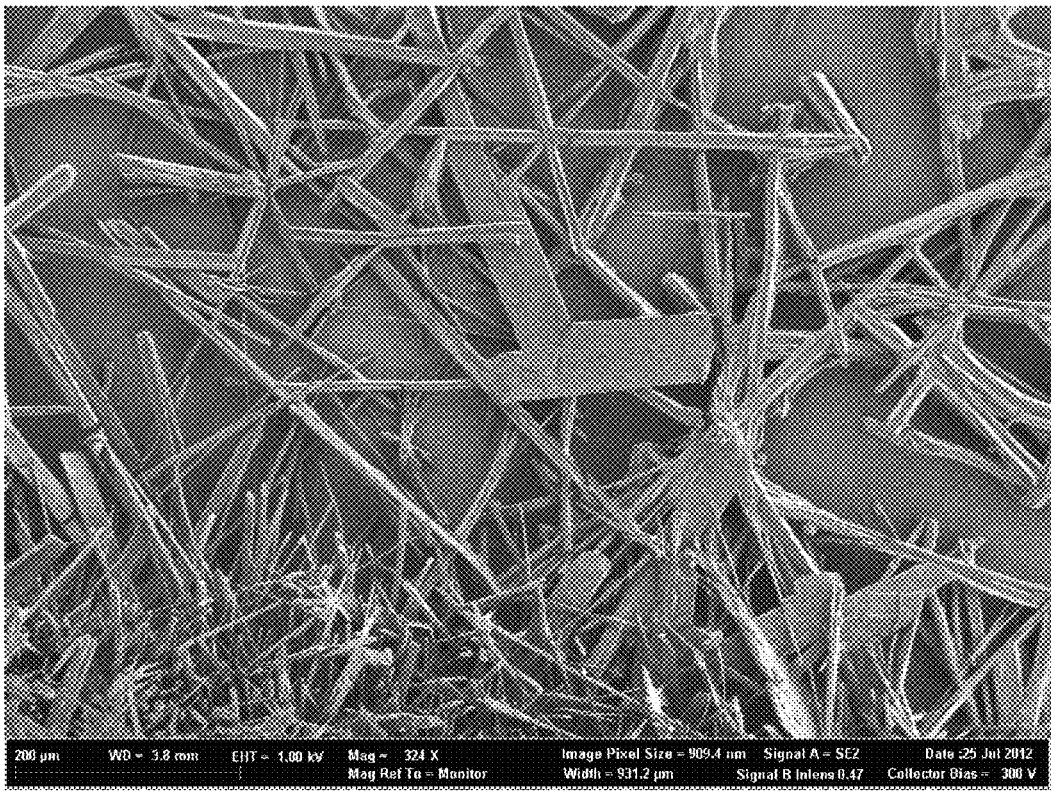
Figure 4:
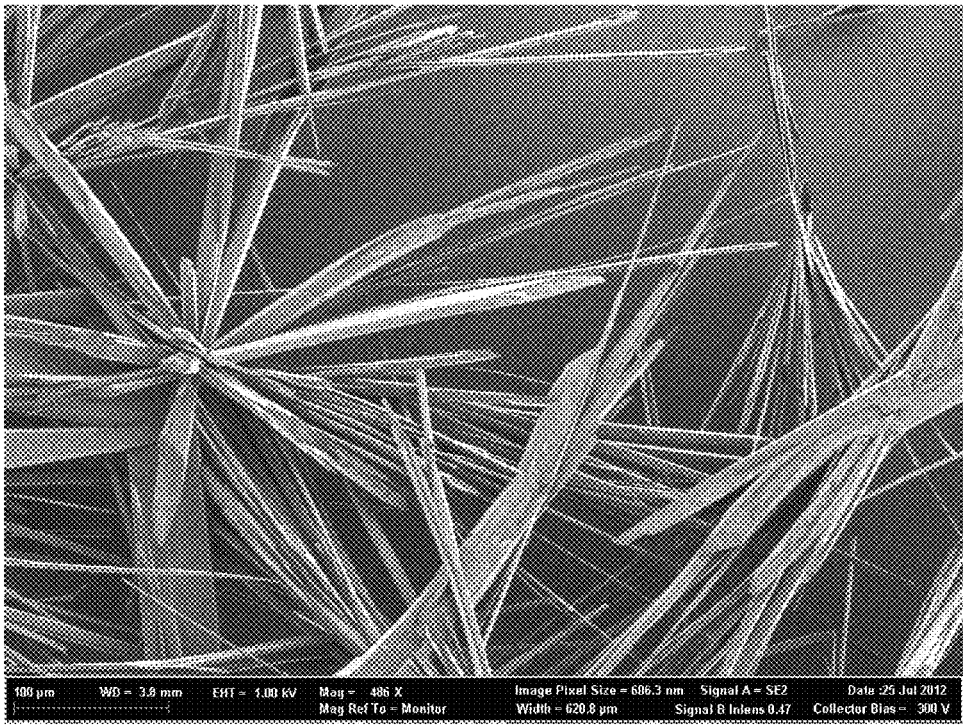

By eye (FIG. 1), it can be seen that the scale was deposited as a ridge-like pattern with thin, alternating regions of rough scale deposits and bare substrate. Example SEM images of the surface are shown in FIGS. 2-4.

Leidenfrost Temperature Measurements

It is presently demonstrated that an initially smooth surface coated by a certain amount of scale outperforms that same smooth surface not coated by a scale layer. This enhancement of heat transfer has been demonstrated by measuring the Leidenfrost temperature of water on the two heated surfaces. The Leidenfrost temperature marks the transition between the nucleate and filmwise boiling regimes. Nucleate boiling is visibly characterized by droplet surface wetting, whereas filmwise boiling occurs when the liquid drop is repelled from the surface. Nucleate boiling is preferred for higher heat transfer coefficients (up to an order of magnitude).

Figure 5:
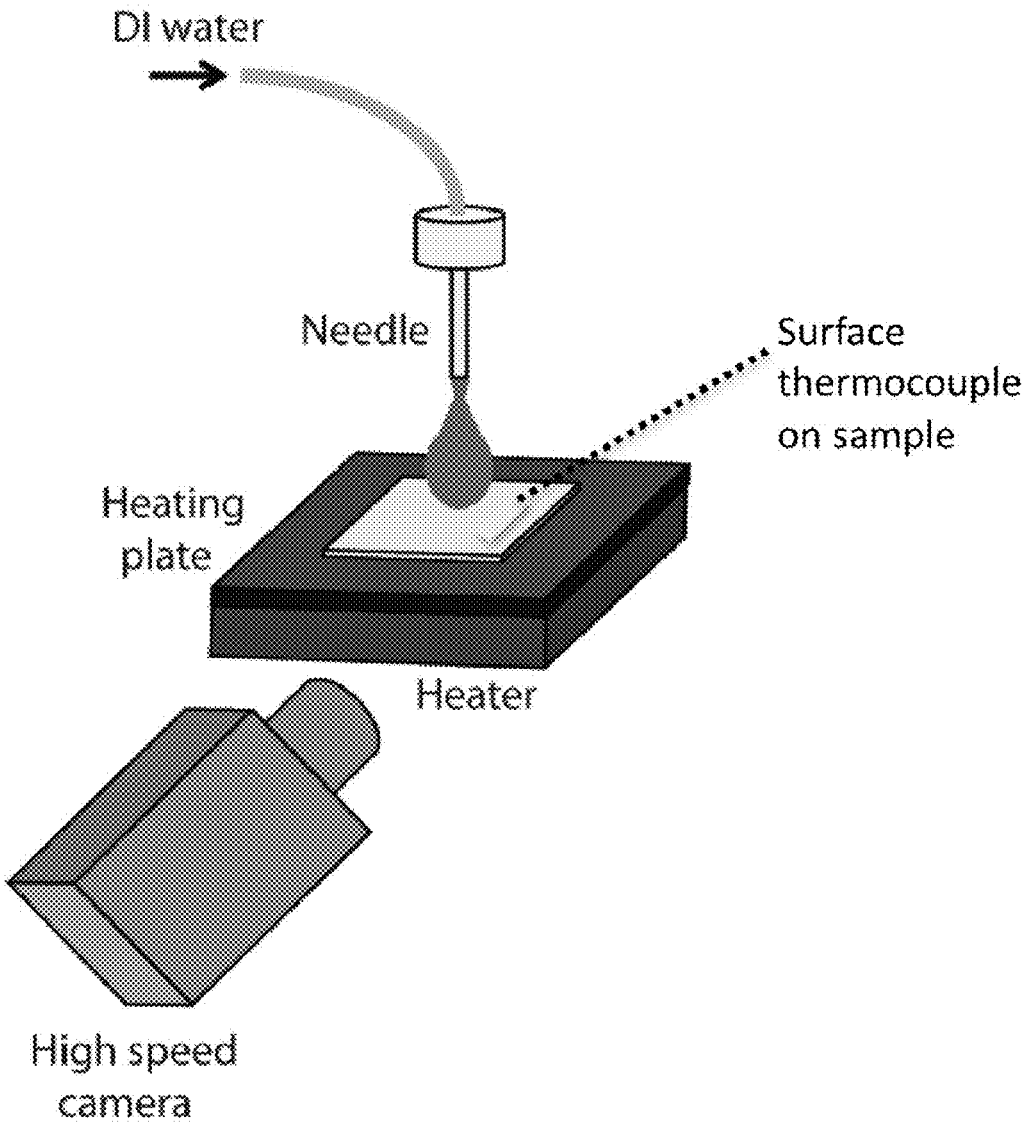
FIG. 5 is a schematic diagram that illustrates the experimental setup for temperature measurement described in Experimental Examples.

An image of the experimental setup is illustrated in FIG. 5. The temperature of the surface was measured by a thermocouple placed on it. For reference, another thermocouple was mounted just below the surface of the heating plate, and the typical temperature difference between the two thermocouples was about 10° C.

The Leidenfrost temperature was determined by heating the surfaces to a given temperature (measured with a thermocouple) and recording the interaction of a water droplet with the surface using a high-speed camera. The water droplet was initially subcooled at room temperature and gently deposited on the surface. The temperature between droplet wetting and nonwetting on the heated surface is the Leidenfrost temperature.

Figure 6:
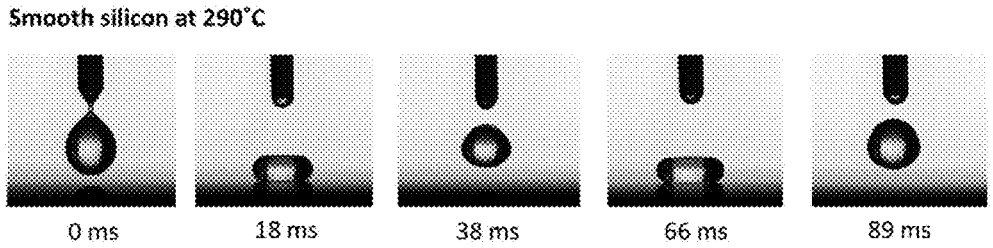
FIG. 6 is a series of photographs illustrating a nonwetting drop on a smooth silicon surface at 290° C., demonstrating a filmwise boiling regime.
Figure 7:
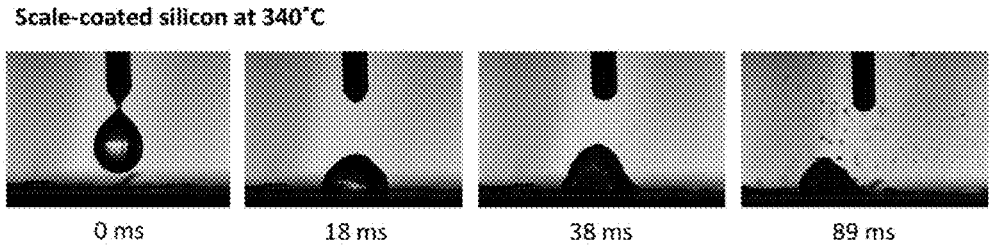
FIG. 7 is a series of photographs illustrating nucleate boiling on the smooth silicon surface that has been coated by a layer of calcium sulfate, according to an illustrative embodiment of the invention.

On a smooth silicon surface at 290° C., the filmwise boiling regime is clearly observed by the nonwetting drop in FIG. 6. In fact, the Leidenfrost temperature for water on a heated surface has been determined to be 270-290° C. After the same smooth silicon surface has been coated by a scale deposition of calcium carbonate (using the method above and shown as low, thin ridges with small spaces between them as in FIG. 1), nucleate boiling still occurs at 340° C. (FIG. 7). A significant enhancement in boiling heat transfer by the scale deposition is observed.

For steam-injection oil recovery, approximately one-third of the produced oil is used to generate steam. Fuel costs account for more than 50% of operation and maintenance costs in a typical California steam injection operation. In these existing steam generators, the enhancement of heat transfer by controlling scale formation reduces fuel costs and has the largest impact on reducing annual operation and maintenance costs. In the deployment of new steam generators, the development of smaller systems based on enhanced heat transfer lowers the capital cost of the project.

While the invention has been particularly shown and described with reference to specific preferred embodiments, it should be understood by those skilled in the art that various changes in form and detail may be made therein without departing from the spirit and scope of the invention as defined by the appended claims.

What is claimed is:

1. A method for promoting nucleate boiling on an interior surface of a vessel for boiling a fluid in an industrial process, the method comprising the steps of:

providing the vessel having the interior surface;

controllably depositing a scale layer having a non-zero thickness onto the interior surface;

monitoring an average thickness, x, of the layer; and maintaining the average thickness, x, of the layer below a predetermined value or within a predetermined range of values during the operational life of the vessel, wherein $x<k/h$, where k is the effective thermal conductivity of the interior surface of the vessel and h is the heat transfer coefficient at the interior surface of the vessel in contact with the boiling fluid.

2. The method of claim 1, further comprising:

reducing the amount of scale if x is above the predetermined value or the predetermined range of values; and measuring x to determine that x is below the predetermined value or within the predetermined range of values.

3. The method of claim 2, wherein the amount of scale is reduced by at least one of mechanical removal of the scale, acoustic break-up of the scale, or application of electric and magnetic fields.

4. The method of claim 1, wherein controllably depositing the scale layer comprises performing at least one of lithography, sputter deposition, laser etching, layer-by-layer deposition, adonization, or application of electric fields.

5. The method of claim 1, wherein the scale is controllably deposited according to a predetermined pattern.

6. The method of claim 1, further comprising: maintaining x below the predetermined value or within the predetermined range of values by inhibiting further scale growth.

7. The method of claim 6, wherein inhibiting further scale growth comprises injecting a substance into the boiling fluid, said substance comprising silica particles or gold nanoparticles.

8. The method of claim 6, wherein inhibiting further scale growth comprises mechanical removal of the scale.

9. The method of claim 8, wherein the mechanical removal comprises injecting abrasive particles configured to fracture the scale deposition.

10. The method of claim 6, wherein inhibiting further scale growth comprises application of a photoactive coating to the interior surface, prior to depositing the scale layer, and exposing the photoactive coating to an external light source.

11. The method of claim 1, wherein maintaining the average thickness, x, comprises measuring x on a regular basis and, if x is measured to be above the predetermined value or the predetermined range of values, reducing x to a non-zero thickness below the predetermined value or the predetermined range of values.

12. The method of claim 1, wherein the scale deposit is a member selected from the group consisting of: calcium sulfate, calcium carbonate, magnesium phosphate, calcium phosphate, barium sulfate, $CaSiO_3$, $MgSiO_3$, silica, iron, hematite, serpentine, gypsum, magnetite, and combinations thereof.

13. The method of claim 1, wherein $x<10$ μm.

14. The method of claim 1, wherein 1 μm$<x<$500 μm.

15. The method of claim 1, wherein the scale layer is porous.

16. The method of claim 1, wherein the interior surface of the vessel comprises one or more materials selected from the group consisting of: copper, brass, steel, stainless steel, aluminum, aluminum bronze, nickel, iron, nickel iron aluminum bronze, polymer, glass, rubber, silicon, polycarbonate, and PVC.

17. The method of claim 1, wherein the scale layer is deposited using a mask with patterned apertures resulting in a patterned scale layer.

18. The method of claim 1, wherein the scale layer covers 10-90% of the interior surface of the vessel.

19. The method of claim 1, further comprising: providing a scale trap, wherein the scale forms on said scale trap.

20. The method of claim 1, further comprising: applying electric and/or magnetic fields to the interior surface of the vessel to bind and remove ions in the boiling fluid.

21. A method for promoting nucleate boiling on an interior surface of a vessel for boiling a fluid in an industrial process, the method comprising the steps of:

providing the vessel having a photoactive coating on the interior surface;

allowing accumulation of a deposit of scale on the interior surface of the vessel up to a maximum average thickness, x, by contact of the interior surface with boiling fluid during normal operation of the vessel in the industrial process; and maintaining x below a predetermined value or within a predetermined range of valued for a substantial period of time during an operational life of the vessel by intermittent or continuous exposure of the photoactive coating to a light source, thereby breaking up scale deposits, wherein $0<x<k/h$, where k is the effective thermal conductivity of the interior surface of the vessel and h is the heat transfer coefficient at the interior surface of the vessel in contact with the boiling fluid.

22. The method of claim 21, further comprising:

reducing the amount of scale if x is above the predetermined value or the predetermined range of values; and measuring x to determine that x is below the predetermined value or within the predetermined range of values.

23. The method of claim 21, further comprising: maintaining x below the predetermined value or within the predetermined range of values by inhibiting further scale growth.

24. The method of claim 21, wherein maintaining the average thickness, x, comprises measuring x on a regular basis and, if the x is measured to be above the predetermined value or the predetermined range of values, reducing x to a non-zero thickness below the predetermined value or the predetermined range of values.

25. A method for promoting nucleate boiling on an interior surface of a vessel for boiling a fluid in an industrial process, the method comprising the steps of:

providing a vessel having an interior surface; and controllably depositing scale onto the interior a surface according to a predetermined pattern to effect boiling heat transfer when in contact with a boiling fluid, wherein the average thickness of the scale layer is x and $0<x<k/h$, where k is the effective thermal conductivity of the interior surface of the vessel and h is the heat transfer coefficient at the interior surface of the vessel in contact with the boiling fluid.

26. The method of claim 25, further comprising: monitoring x.

27. The method of claim 25, further comprising: maintaining x below a predetermined value or within a predetermined range of values during the operational life of the vessel.

28. The method of claim 25, wherein at least a portion of the surface area of the interior surface of the vessel is covered with scale, and at least a portion of the surface area of the interior surface of the vessel is not covered with scale.

29. The method of claim 25, wherein the deposit of scale has a first area and a second area, and x is greater in the first area than in the second area.

* * * * *